United States Patent [19]

Kircher et al.

[11] 4,439,297

[45] Mar. 27, 1984

[54] MONOPOLAR MEMBRANE ELECTROLYTIC CELL

[75] Inventors: Morton S. Kircher, Clearwater, Fla.; David D. Justice, Cleveland, Tenn.; Kenneth E. Woodard, Jr., Cleveland, Tenn.; Charles H. Harrison, Cleveland, Tenn.

[73] Assignee: Olin Corporation, New Haven, Conn.

[21] Appl. No.: 307,352

[22] Filed: Oct. 1, 1981

[51] Int. Cl.[3] ..... C25B 9/00; C25B 11/03; C25B 11/06; C25B 13/08

[52] U.S. Cl. ..... 204/257; 204/263; 204/279; 204/283; 204/290 R; 204/296; 204/289

[58] Field of Search ..... 204/252–258, 204/263–266, 283–284, 286, 288–289, 290 R, 296, 293, 279

[56] References Cited

U.S. PATENT DOCUMENTS

| | | | |
|---|---|---|---|
| 3,932,261 | 1/1976 | Kircher et al. | 204/288 |
| 4,056,458 | 11/1977 | Pohto et al. | 204/263 |
| 4,108,742 | 8/1978 | Seko et al. | 204/98 |
| 4,176,215 | 11/1979 | Molnar et al. | 521/27 |
| 4,204,920 | 5/1980 | Kurtz et al. | 204/98 |
| 4,210,516 | 7/1980 | Mose et al. | 204/284 |
| 4,298,697 | 11/1981 | Baczek et al. | 204/296 X |
| 4,312,737 | 1/1982 | Kircher | 204/288 X |
| 4,341,604 | 7/1982 | De Nora et al. | 204/283 X |
| 4,370,361 | 1/1983 | Gray | 204/293 X |

*Primary Examiner*—Donald R. Valentine
*Attorney, Agent, or Firm*—James B. Haglind; Donald F. Clements

[57] ABSTRACT

A monopolar membrane electrolytic cell is comprised of a plurality of anodes wherein each anode is comprised of a first foraminous surface and a second foraminous surface positioned in parallel and spaced apart, and a frame enclosing the first and the second foraminous surfaces. The frame has two side members, a top member, and a bottom member attached to the foraminous surfaces. A chamber is formed between the foraminous surfaces and bounded by the frame. Conductor rods pass through one of the side members of the frame into the chamber, the conductor rods being spaced apart from the foraminous surfaces. Foraminous conductive connectors are positioned in the chamber and attached to the conductor rods and to the foraminous surfaces; a plurality of cathodes wherein each cathode is comprised of at least one foraminous surface, and a frame which encloses the foraminous surface. The cathodes are alternatingly interleaved with the anodes; a plurality of sheets of cation exchange membrane material, each of the sheets being pressed between each opposite pair of the anodes and the cathodes. The cation exchange membrane material is comprised of a blend of a first fluorinated polymer which contains sulfonyl functional groups and a second fluorinated polymer which contains carboxylic acid functional groups; the cell has raw material supply conduits and product withdrawal conduits communicating with the interior of each of the anodes and the cathodes; means for supplying electric current to the anodes and removing electric current from the cathodes are provided, and pressing means provided for pressing the anodes and the cathodes together to form a substantially fluid-tight cell.

9 Claims, 3 Drawing Figures

MONOPOLAR MEMBRANE ELECTROLYTIC CELL

This invention relates to novel membrane type electrolytic cells and particularly to monopolar filter press cells.

Commercial cells for the production of chlorine and alkali metal hydroxides have been continually developed and improved over a period of time dating back to at least 1892. In general, chlor-alkali cells are of the deposited asbestos diaphragm type or the flowing mercury cathode type. During the past few years, developments have been made in cells employing ion exchange membranes (hereafter "membrane cells") which promise advantages over either diaphragm or mercury cells. It is desirable to take advantage of existing technology particularly in diaphragm cells, but it is also necessary to provide cell designs which meet the requirements of the membranes. Since suitable membrane materials such as those marketed by E. I. DuPont de Nemours and Company under the trademark Nafion ® and by Asahi Glass Company Ltd. under the trademark Flemion ® are available principally in sheet form, the most generally used of the membrane cells are of the "filter press" type. In the filter press type of cell, membranes are clamped between the flanges of filter press frames. Filter press cells are usually of the bipolar type. Bipolar filter press cells have been found to have several disadvantages, such as:

(a) corrosion between connections from anodes to cathodes through the separating plate; and (b) electrical leakage from one cell to another through inlet and outlet streams.

Furthermore, bipolar cell circuits designed for permissible safe voltages of about 400 volts are small in production capacity and are not economical for a large commercial plant. The failure of one cell in a bank of bipolar filter press cells normally requires shutting down the entire filter press bank.

Filter press cells of monopolar design are not well known, probably because of the substantial practical problem of making electrical connections between the unit frames in the filter press and between one cell and the next. Tying all of the anodes together with a single electrical bus and tying all of the cathodes together with a single electrical bus interferes with drawing the frames together to form the seal between frames and membranes. On the other hand, use of flexible cables from cell to cell provides no way of removing one cell at a time from the circuit without interrupting the current for the entire circuit.

One example of a monopolar membrane filter press cell is described in U.S. Pat. No. 4,056,458, issued Nov. 1, 1977, to Pohto et al. The Pohto et al patent discloses a cell which, like bipolar filter press cells, has the electrodes and end plates oriented perpendicular to the overall path of current flow through the cell. Specifically, Pohto et al disclose a central electrode assembly sandwiched between two end electrode assemblies, with membranes in between, to form a closed cell. A plurality of central electrode assemblies apparently may also be sandwiched in a similar manner. Pohto et al disclose connecting the cells to bus bars in a system in which electrode rods of both polarities extend from the cell top.

Monopolar filter press cells which have the electrodes oriented to provide a horizontal path of current flow through the cell have significant advantages over those providing a vertical current path through the cell. In these "side-stack" cells, the electrode elements and membranes are formed into a stack of "electrode packs" which are bolted between end frames. An electrode pack includes a pair of electrodes of opposite polarity separated by a diaphragm or membrane. The end frames support the pack to form a convenient unit with respect to capacity, floor space, and portability. As the number of units in the stack are usually limited to less than about 50, problems with leakage are greatly reduced. Also virtually eliminated are problems with deformation of connecting bus bars due to temperature changes, which are serious with conventional filter press cells. Another advantage of the monopolar filter press cell is that, in case of failure of a membrane, only a single cell including less than about 50 membranes need be removed for dismantling, repair and reassembly. This is more economical than either taking out the entire filter press assembly on the one hand or providing an expensive arrangement for replacing individual membranes on the other hand. Still another advantage is that electrode structures having horizontally oriented conductors permit the construction of an extraordinarily high cell, while maintaining a short direct current path through the cell, thereby minimizing the amount of conductor material required for the cell and thereby minimizing voltage losses through the conductors of the cell. Yet another advantage of side-stack cells is that they employ intercell electrical connections which make taking a cell out of service relatively fast and simple.

Because of the substantial increases in the cost of electric power, it is desirable to provide further improvements in monopolar filter press cells to reduce the cell voltage required to operate the cell, for example, in the electrolysis of alkali metal chloride brines to produce chlorine gas and alkali metal hydroxide solutions. While several factors contribute to operational cell voltages above the theoretical cell voltage for the particular electrolytic process being practiced, electrode overvoltages are important contributors to increased cell voltages. For example, in the electrolysis of alkali metal chloride brines, a chlorine overvoltage occurs at the anode and a hydrogen overvoltage occurs at the cathode. The reduction of these electrode overvoltages results in a decrease in power consumption of the cell and lower energy costs.

It is therefore an object of the present invention to provide a membrane monopolar electrolytic cell having reduced cell voltages.

Another object of the present invention is to provide a membrane monopolar electrolytic cell having reduced electrode overvoltages. These and other objects of the present invention are accomplished in a monopolar membrane electrolytic cell which comprises:

(a) a plurality of anodes wherein each anode is comprised of a first foraminous surface and a second foraminous surface positioned in parallel and spaced apart, and a frame enclosing the first and the second foraminous surfaces, the frame having two side members, a top member, and a bottom member attached to the foraminous surfaces, a chamber formed between the foraminous surfaces and bounded by the frame, conductor rods passing through one of the side members of the frame into the chamber, the conductor rods being spaced apart from the foraminous surfaces, foraminous conductive connectors positioned in the chamber and attached to the conductor rods and to the foraminous surfaces;

(b) a plurality of cathodes wherein each cathode is comprised of at least one foraminous surface, and a frame enclosing the foraminous surface, the cathodes being alternatingly interleaved with the anodes;

(c) a plurality of sheets of cation exchange membrane material, each of the sheets being pressed between each opposite pair of anodes and cathodes, the cation exchange membrane material being comprised of a blend of 10 to 90 percent by weight of a first fluorinated polymer which has repeating units

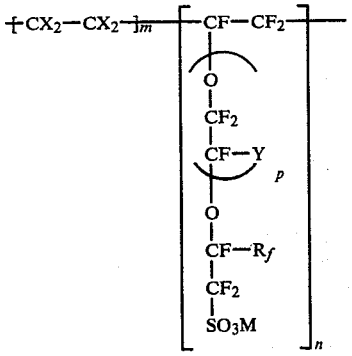

where m is 3 to 15, n is 1 to 10, p is 0, 1, or 2, the X's taken together are four fluorines or three fluorines and one chlorine, Y is F or $CF_3$, $R_f$ is F, Cl, or a $C_1$ to $C_{10}$ perfluoroalkyl radical, and M is H or alkali metal, and 90 to 10 percent by weight of a second fluorinated polymer which has repeating units

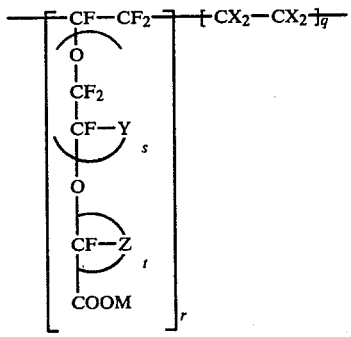

where q is 3 to 15, r is 1 to 10, s is 0, 1, or 2, t is 2, the X's taken together are four fluorines or three fluorines and one chlorine, Y is F or $CF_3$, Z is F or $CF_3$, and M is H or alkali metal;

(d) raw material supply conduits and product withdrawal conduits communicating with the interior of each of the anodes and the cathodes;

(e) means for supplying electric current to the anodes and removing electric current from the cathodes; and (f) pressing means for pressing the anodes and the cathodes together to form a substantially fluid-tight cell.

The invention will be better understood by reference to the attached drawings which are provided by way of illustration wherein.

It is to be understood that the filter press membrane cell described in the instant disclosure includes a plurality of electrodes. The electrodes are anodes and cathodes arranged in alternating sequence as will be described in greater detail hereafter. The term "anode" or "cathode" is intended to describe the entire electrode unit which is comprised of a frame which encases the periphery of the appropriate electrode and on opposing sides has anodic or cathodic surfaces, as appropriate, attached thereto. The space within the individual electrode between the electrode surfaces comprises the major portion of the compartment through which the anolyte or catholyte fluid, as appropriate, passes during the electrolytic process. The particular electrode compartment is defined by the pair of membranes that are placed adjacent, but exteriorly of the opposing electrode surfaces, thereby including the opposing electrode surfaces within each compartment. The term "anode" or "cathode" is further intended to encompass the electrical current conductor rods that pass the current through the appropriate electrode, as well as any other elements that comprise the entire electrode unit.

Figure 1:
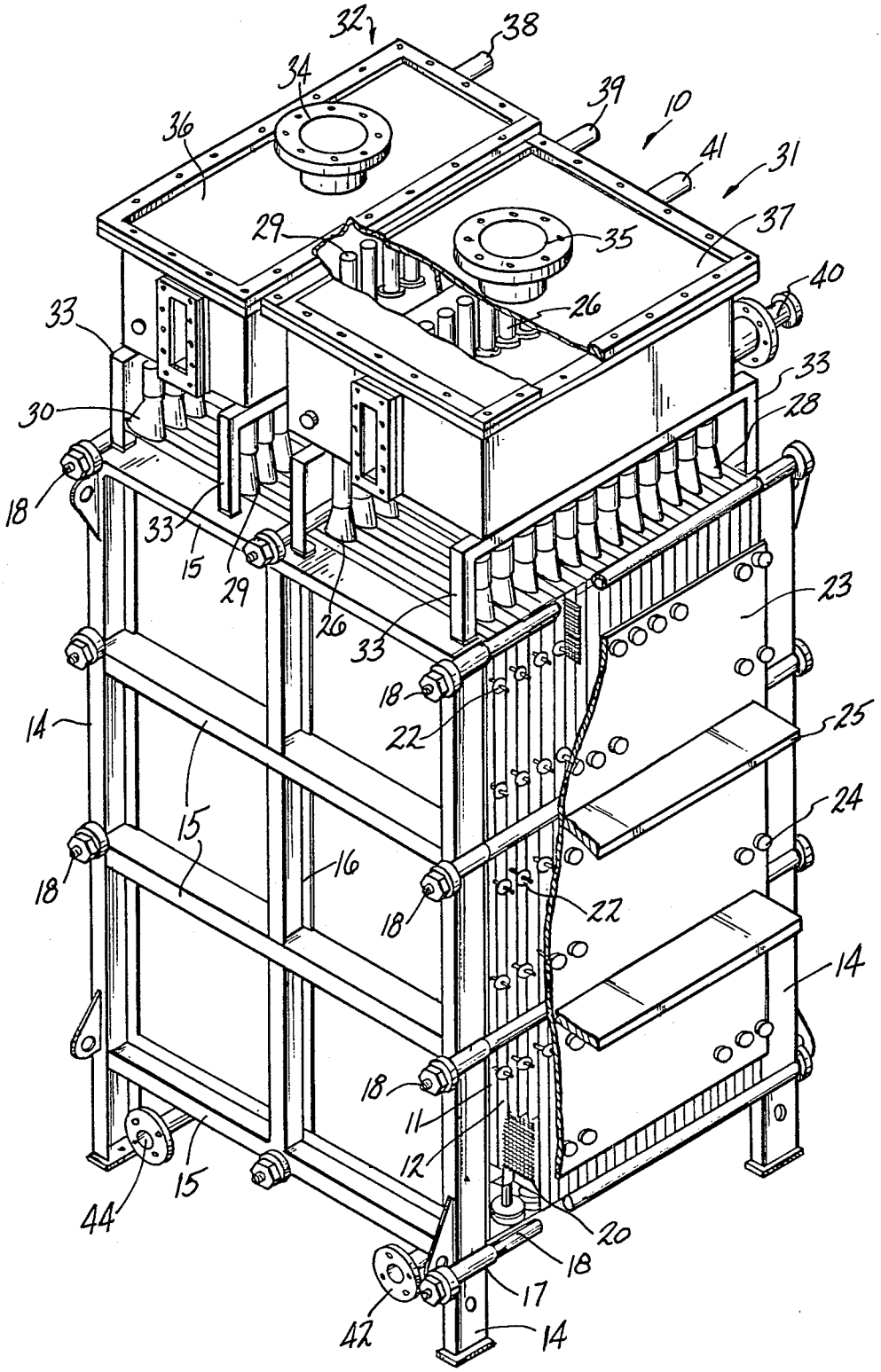
FIG. 1 is a side perspective view of a monopolar filter press membrane electrolytic cell with appropriate portions broken away to illustrate the anodes, cathodes, anolyte disengager, the catholyte disengager, and partially diagrammatically showing the positioning of the ion-selectively permeable membranes between each pair of electrode frames.

Referring to FIG. 1, a filter press membrane cell, indicated generally by the numeral 10, is shown in a side perspective view. It can be seen that cathodes 11 and anodes 12 alternate and are oriented generally vertically. The cathodes 11 and anodes 12 are supported by vertical side frame members 14, horizontal side frame members 15, and intermediate vertical side frame members 16 (only one of which is shown). Cation exchange membranes 20 are positioned between the cathodes 11 and anodes 12 which are pressed together and secured by a series of tie bolts 18 inserted through appropriate mounting means affixed to the vertical side frame members 14 and horizontal side frame members 15. To prevent short circuiting between the electrodes during the electrolytic process, the tie bolts 18 have tie bolt insulators 17 through which the tie bolts 18 are passed in the area of the cathodes 11 and anodes 12.

Projecting from the top of anodes 12 and cathodes 11 are a series of fluid flow conduits. Anode risers 26 and anode downcomers or anolyte return lines 28 project from the top of each anode frame 12. Similarly, cathode risers 29 and cathode downcomers or catholyte return lines 30 are shown projecting from the top of each cathode 11. The risers are generally utilized to carry the appropriate electrolyte fluid with the accompanying gas, either anolyte with chlorine gas or catholyte with hydrogen gas, to the appropriate disengager mounted atop the filter press membrane cell 10. The anolyte disengager is indicated generally by the numeral 31, while the catholyte disengager is indicated generally by the numeral 32. Each disengager is supported atop of the cell 10 by disengager supports 33. It is in each of these disengagers that the entrained gas is separated from the liquid of the anolyte or catholyte fluid, as appropriate, and is released from the appropriate disengager via either a cathode gas release pipe 34 or an anode gas release pipe 35 affixed to the appropriate catholyte disengager cover 36 or anolyte disengager cover 37.

Also partially illustrated in FIG. 1 is the catholyte replenisher conduit 38 which carries deionized water into the catholyte disengager 32. The deionized water is appropriately fed through the catholyte disengager 32 to each cathode 11 in cell 10. A catholyte outlet pipe 39 is also partially illustrated and serves to control the level of liquid in the catholyte fluid in the catholyte disengager 32 by removing caustic to its appropriate processing apparatus.

An anolyte replenisher conduit 40 carries fresh brine into the anolyte disengager 31 and is best seen in FIG. 1. The fresh brine is then appropriately fed into each anode 12 where it is mixed with the existing anolyte fluid which is recirculated from the anolyte disengager 31 into each anode 12 via the downcomers 28. An anolyte outlet pipe 41 is also shown and serves to control the level of liquid in the anolyte fluid within the anolyte disengager 31 by removing the spent brine from the anolyte disengager 31 for regeneration.

Also shown in FIG. 1 are a cathodic bottom manifold 42 and an anodic bottom manifold 44, which are utilized to drain the appropriate electrodes.

The filter press membrane cell 10 has been described only generally since the structure and the function of its central components are well known to one of skill in the art.

Figure 2:
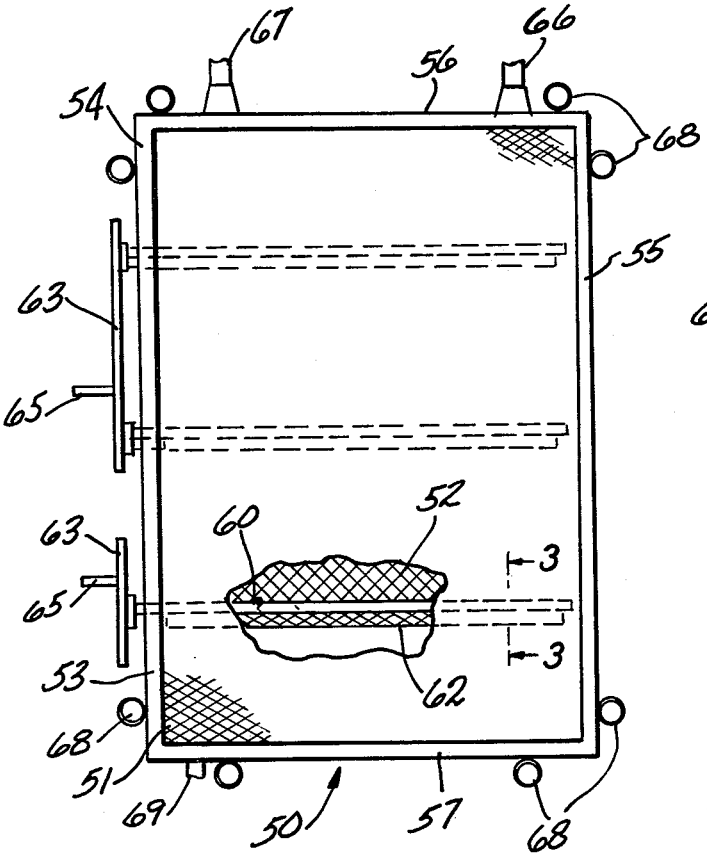
FIG. 2 illustrates a front view of an electrode used in the electrolytic cell of the present invention with portions cut away.
Figure 3:
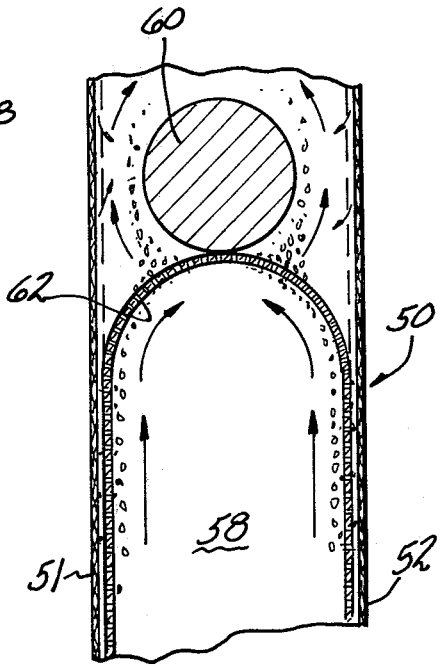
FIG. 3 depicts an enlarged schematic partial end view of a partial section of the electrode of FIG. 2 taken along line 3—3 showing fluid flow patterns through the foraminous connective conductor.

Electrode 50 of FIGS. 2 and 3 is comprised of vertical foraminous surfaces 51 and 52 positioned in parallel and spaced apart. Frame 53 is comprised of side members 54 and 55, top member 56, and bottom member 57. Foraminous surfaces 51 and 52 are attached to frame 53 to form chamber 58 between foraminous surfaces 51 and 52 and bounded by frames 53. Conductor rods 60 are positioned in chamber 58 and are spaced apart from foraminous surfaces 51 and 52. Foraminous conductive connectors 62 are attached to conductor rods 60 and foraminous surfaces 51 and 52 and supply electric current from conductor rods 60 to foraminous surfaces 51 and 52. Side member 54 has openings for conductor rods 60 which are electrically connected to electrode collectors 63 to which terminals 65 are attached. Guides 68 are included on frame 53 to allow for proper alignment with adjacent electrode frames. Gaskets or other sealant materials are suitably placed around the frame to permit a series of interleaved anode and cathode frames to be sealingly compressed to form monopolar filter press cell 10. Outlet 66 passes the gas-containing electrolyte produced to disengager 31 or 32 and gas-free electrolyte is returned through inlet 69. Inlet 69 feeds a liquid into electrode 50.

FIG. 3 presents an enlarged schematic partial end view of the electrode along lines 3—3 of FIG. 2 in which foraminous conductive connectors 62 are attached to foraminous surfaces 51 and 52 and conductor rod 60. Gas bubbles generated during the electrolysis process pass through openings in conductive connectors 62 and flow around conductor rod 60.

Referring to FIGS. 1 and 2, where electrode 50 is an anode, it is seen that the overall current flow path through cell 10 is horizontal, passing from an external power source through anode terminals 65 to cathode terminals 25. Conductor rods 60 are anode conductor rods and receive current from anode terminals 65 via anode collectors 63. Conductor rods 60 supply current through foraminous conductive connectors 62 to anode surfaces 51 and 52 and then through the anolyte, membrane 20, and the catholyte to the cathode surfaces. From the cathode surfaces, current is passed to cathode conductor rods 22 and then to cathode collectors 23 to cathode terminals 25. Thus it is seen that current flows in a very straight and direct path with the only transverse flow occuring through the actual inter-electrode gap. In a series of cells, if an electrode frame or membrane of any one of the cells is damaged, it is a simple matter to bypass current around the cell containing the damaged frame or membrane while allowing the current to flow through the other cells. In this manner, a minimum amount of interruption in production results. In fact, a spare cell is preferably available and could be substituted for any disconnected cell which was removed for repair.

The electrodes used in the monopolar membrane cell of the present invention include a plurality of conductor rods. The conductor rods extend through a side of the electrode frame and into the chamber between the electrode surfaces. Within the chamber, the conductor rods are spaced apart from the foraminous surfaces. The conductor rods may be positioned substantially horizontal or sloped. One end of the conductor rods is attached to the electrode collectors. In another embodiment, the conductor rods have a first portion which is substantially horizontal for attachment to the electrode collectors and a second portion within the chamber which is sloped or curved. The shape or curvature of this second portion may be, for example, from about 1 to about 30, and preferably from about 2 to about 10 degrees from the horizontal, referenced from the horizontal portion for attachment to the electrode collectors. While the term conductor rod has been employed, the conductors may be in any convenient physical form such as rods, bars, or strips. While rods having a circular cross section are preferred, other shapes such as flattened rounds, elipses, etc. may be used.

Where the electrodes of the present invention are employed as anodes, for example, in the electrolysis of alkali metal chloride brines, the conductor rods are suitably fabricated from a conductive metal such as copper, silver, steel, magnesium, or aluminum covered by a chlorine-resistant metal such as titanium or tantalum. Where the electrodes serve as the cathodes, the conductor rods are suitably composed of, for example, steel, nickel, copper, or coated conductive materials such as nickel coated copper.

Attached to the conductor rods, for example, by welding, brazing, or the like, are foraminous conductive connectors which are also attached to the two electrode surfaces. Being positioned with the conductor rods between the electrode surfaces, the foraminous conductive connectors are attached along the side of the electrode surfaces not facing an adjacent oppositely charged electrode. The ends of the foraminous conductive connectors may be attached to opposite electrode surfaces or to the same electrode surface. The foraminous conductive connectors conduct electric current from the conductor rods to the electrode surfaces and are thus selected to provide good electrical conductivity. The foraminous conductive connectors may be in various forms, for example, wire, mesh, expanded metal mesh which is flattened or unflattened, perforated sheets, and a sheet having slits, or louvered openings, with an expanded metal mesh form being preferred. Further, the foraminous conductor supports need to provide sufficient free space to permit adequate fluid flow up through the electrode. For example, the open area of the mesh of the foraminous conductive connectors should be from about 0.2 to about 2 times the interior horizontal cross sectional area of the electrode, for example, in a plane orthogonal to the interior surfaces of 14 and 16 of FIGS. 2–3.

It is desirable in selecting the form of the foraminous conductive connector that it be geometrically compatible with the form of the electrode surface so that suitable connections can be made.

Suitable configurations for the foraminous conductive connectors include "U" or "V" shaped curves which may be in the normal or upright position or inverted. A preferred configuration for the foraminous conductor support is an inverted "U" of the type illustrated in FIG. 3. This configuration collects rising gas bubbles and allows the collected gas to stream as larger bubbles upward through the openings. Because of its shape, gas evolution is directed toward the center of the channel and away from the membrane. Where, for example, the electrodes are employed as anodes in the electrolysis of alkali metal chloride brines, chlorine gas impingement against the membrane is detrimental to the life span of the membrane. In addition, gas rising along a curved surface of the underside of the conductor rod, in the restricted cross section area between the rod and the electrode surface, creates a Venturi effect by providing a low pressure zone. A flow of electrolyte inward through the electrode surfaces bounding this low pressure zone prevents the impingement of gas on the membrane both under and alongside of the conductor rods. While the embodiment in FIG. 3 shows a semicircular form of an inverted U, other forms including parabolic, semi-elliptical, semi-octagonal, and semi-rectangular may be employed as foraminous conductive connector 62.

To promote suitable fluid flow up through the electrode chamber while minimizing turbulence, particularly in the upper portions of the electrode chamber, the size of the conductor rods and the openings in the foraminous conductor supports are selected to provide a superficial velocity of gas flow in the space between the conductor rod and the electrode surface in the range of from about 0.05 to about 1.00, and preferably from about 0.10 to about 0.50 meters per second.

This electrode structure not only permits fluid flow up through the electrode chamber to be maintained at desired rates, but also allows the ratio of liquid to gas present in the fluid to be adjusted so that foam formation in the cell can be minimized or eliminated. For example, in the electrolysis of an alkali metal chloride brine such as sodium chloride, use of the electrode in the cell of the present invention as an anode permits the liquid portion of the fluid in, for example, the upper third of the electrode to be greater than 70 percent, preferably greater than 80 percent, and more preferably from about 85 to about 95 percent by volume of the fluid, chlorine gas being the other component.

Further, in an electrolytic cell in which the anolyte is fed through a downcomer to the bottom of the anodes, higher fluid pressures are normally also found in the bottom of the anodes. However, using the above-described electrodes, higher pressures are found, for example, at about one-half the electrode height. This is believed to be the result of a pumping action which occurs when the gas bubbles are compressed under each conductive connector, the bubbles coalesce and are released through the conductive connectors at a higher velocity, the velocity increasing at each stage.

The electrochemically active electrode surfaces for the electrodes are those which may be suitably employed in commercial cells, for example, for the production of chlorine and alkali metal hydroxides by the electrolysis of alkali metal chloride brines. Typically, where the electrode surfaces serve as the anode, a valve metal such as titanium or tantalum is used. The valve metal has a thin coating over at least part of its surface of a platinum group metal, platinum group metal oxide, an alloy of a platinum group metal or a mixture thereof. The term "platinum group metal" as used in the specification means an element of the group consisting of ruthenium, rhodium, palladium, osmium, iridium, and platinum.

The anode surfaces may be in various forms, for example, a screen, mesh, perforated plate, or an expanded vertical mesh which is flattened or unflattened, and having slits horizontally, vertically, or angularly. Other suitable forms include woven wire cloth, which is flattened or unflattened, bars, wires, or strips arranged, for example, vertically, and sheets having perforations, slits, or louvered openings.

A preferred anode surface is a foraminous metal mesh having good electrical conductivity in the vertical direction along the anode surface.

As the cathode, the electrode surface is suitably a metal screen or mesh where the metal is, for example, iron, steel, nickel, or tantalum, with nickel being preferred. If desired, at least a portion of the cathode surface may be coated with a catalytic coating such as Raney nickel or a platinum group metal, oxide, or alloy as defined above.

As a preferred embodiment, the cathode has a Raney-type nickel catalytic surface predominantly derived from an adherent Beta phase ($NiAl_3$) crystalline precursory outer portion of the metal core, as described in U.S. Pat. No. 4,240,895, issued Dec. 23, 1980, to T. J. Gray. The precursory outer portion preferably has molybdenum added to give a precursor alloy having the formula $Ni_xMo_{1-x}Al_3$ where x is in the range of from about 0.75 to about 0.99 weight percent and preferably from about 0.80 to about 0.95.

Cathodes having a Beta phase Raney nickel catalytic coating have been found to exhibit very low cathode polarization values (hydrogen overvoltages) when used in the monopolar membrane electrolytic cell of the present invention for the electrolysis of alkali metal chloride brines. Thus in a monopolar membrane electrolytic cell in which an aqueous solution containing 24–26 weight percent of NaCl was electrolyzed at a cathode current density of 200 milliamps per square centimeter of cathode surface while maintaining the cell temperature at 85° C. and the catholyte concentration at 11 weight percent of NaOH and 15 weight percent of NaCl, the hydrogen overvoltage of a Beta phase Raney nickel alloy containing 15 percent by weight of molybdenum over a 45 day period remained constant at 60 millivolts. Under identical conditions, mild steel had a hydrogen overvoltage of 540 millivolts.

Cathodes having catalytic coatings which are predominantly Beta phase Raney nickel are prepared by a process wherein an interdiffused nickel-aluminum alloy layer is formed, from which aluminum is subsequently selectively leached. The process includes the steps of (a) preparing a metallic core with a nickel-bearing outer layer, (b) aluminizing the surface of the core, (c) interdiffusing the aluminum and nickel, (d) selectively leaching aluminum from the inter-diffused material, (e) optionally chemically treating to prevent potential pyrophoricity and (f) optionally coating with nickel to improve the mechanical properties of the final surface.

The metallic core which comprises the starting material for the electrode is prepared to have a nickel-bearing outer layer in which the nickel concentration is at least 15 percent, and preferably at least 18 percent by weight. When the core is of substantially pure nickel or an appropriate nickel-bearing alloy such as Inconel 600, Hastelloy C or 310 Stainless Steel, the core inherently has the desired nickel-bearing outer layer.

For cores of other metals or alloys, a nickel coating can be deposited on the core by known techniques, such as metal dipping, electroplating, electroless plating and the like. The nickel-bearing outer layer of the core, whether provided by the core metal itself or as a deposited coating, is conveniently at least 100 microns thick, and preferably at least 150 microns thick. The maximum thickness of the nickel bearing outer layer is a matter of convenience and economic choice. Although cores in the form of screens or plates, especially screens, are preferred, cores made from foils, wires, tubes or expanded metal are also suitable.

As shown in FIG. 2, frame 53 surrounds and encloses the electrode surfaces. It will be noted that, for example, the electrode frames are shown to be of picture-frame type configuration with four peripheral members and two parallel, planar, mesh surfaces attached to the front and back of the frame. These members could be in the shape of rectangular bars, circular tubes, elliptical tubes as well as being I-shaped or H-shaped. An inverted channel construction is preferred for the top member in order to allow the top member to serve as a gas collector. Preferably, this top inverted channel is reinforced at its open bottom to prevent bending, buckling, or collapse. The remaining members could be of any suitable configuration which would allow the frames to be pressed together against a gasket in order to achieve a fluid-tight cell. While a flat front and rear surface is shown for the members, it would be possible to have many other configurations such as round or even ridged channels. The electrode surface is shown in FIG. 2 to be welded to the inside of the peripheral members of the frame, but could be welded to the front and back outside surfaces if the configuration of such outside surfaces did not interfere with gasket sealing when the electrode surfaces were on the outside rather than inside.

With the possible exception of the selection of materials of construction, frames 53 may be employed as anode frames or cathode frames in the electrodes of the present invention.

Membranes which can be employed in the electrolytic cell of the present invention are inert, flexible membranes having ion exchange properties and which are substantially impervious to the hydrodynamic flow of the electrolyte and the passage of gas products produced in the cell. Suitably used are cation exchange membranes such as those comprised of fluorocarbon polymers having a plurality of pendant sulfonic acid groups or carboxylic acid groups or mixtures of sulfonic acid groups and carboxylic acid groups. The terms "sulfonic acid groups" and "carboxylic acid groups" are meant to include salts of sulfonic acid or salts of carboxylic acid which are suitably converted to or from the acid groups by processes such as hydrolysis.

Preferred as cation exchange membranes are those comprised of a blend of a fluorinated polymer which has sulfonyl functional groups and a polymer which has carboxylic acid functional groups. Membranes of this type are described in U.S. Pat. No. 4,176,215, issued Nov. 27, 1979, to C. J. Molnar et al, the entire disclosure of which is incorporated by reference. These membranes are made by blending a melt-fabricable form of a first fluorinated polymer which contains sulfonyl functional groups and a melt-fabricable form of a second fluorinated polymer which contains carboxylic functional groups.

The melt fabricable first polymer having sulfonyl functional groups is typically a polymer having a fluorinated hydrocarbon backbone chain to which are attached the functional groups or pendant side chains which in turn carry the functional groups. The pendant side chains can contain, for example, $$-\underset{\underset{R_f}{|}}{CF}-CF_2-SO_2F$$

groups wherein $R_f$ is F, Cl, or a $C_1$ to $C_{10}$ perfluoroalkyl radical. Ordinarily, the functional group in the side chains of the polymer will be present in terminal $$-O-\underset{\underset{R_f}{|}}{CF}-CF_2SO_2F$$

groups.

Examples of fluorinated polymers of this kind are disclosed in U.S. Pat. Nos. 3,282,875; 3,560,568, and 3,718,627. More specifically, the polymers can be prepared from monomers which are fluorinated or fluorine substituted vinyl compounds. The polymers are made from at least two monomers, with at least one of the monomers coming from each of the two groups, described below.

The first group is fluorinated vinyl compounds such as vinyl fluoride, hexafluoropropylene, vinylidene fluoride, trifluoroethylene, chlorotrifluoroethylene, perfluoro(alkyl vinyl ether), tetrafluoroethylene, and mixtures thereof. In the case of copolymers.which will be used in electrolysis of brine, the precursor vinyl monomer desirably will not contain hydrogen.

The second group of the sulfonyl-containing monomers contain the precursor group $$-\underset{\underset{R_f}{|}}{CF}-CF_2SO_2F,$$

wherein $R_f$ is as defined above. Additional examples can be represented by the general formula $CF_2{=}CF{-}T_k{-}CF_2SO_2F$ wherein T is a bifunctional fluorinated radical comprising 1 to 8 carbon atoms, and k is 0 or 1. Substituent atoms in T include fluorine, chlorine, or hydrogen, although generally hydrogen will be excluded in use of the copolymer for ion exchange in a chloralkali cell. The most preferred polymers are free of both hydrogen and chlorine attached to carbon, i.e., they are perfluorinated, for greatest stability in harsh environments. The T radical of the formula above can be either branched or unbranched, i.e., straight-chain and can have one or more ether linkages. It is preferred that the vinyl radical in this group of sulfonyl fluoride containing comonomers be joined to the T group through an ether linkage, i.e., that the comonomer be of the formula $CF_2{=}CF{-}O{-}T{-}CF_2{-}SO_2F$. Illustrative of such sulfonyl fluoride containing comonomers are $CF_2{=}CFOCF_2CF_2SO_2F$, $$CF_2{=}CFOCF_2\underset{\underset{CF_3}{|}}{C}FOCF_2CF_2SO_2F,$$

$$CF_2{=}CFOCF_2\underset{\underset{CF_3}{|}}{C}FOCF_2\underset{\underset{CF_3}{|}}{C}FOCF_2CF_2SO_2F,$$

$$CF_2{=}CFCF_2CF_2SO_2F, \text{ and}$$

$$CF_2{=}CFOCF_2\underset{\underset{\underset{\underset{CF_3}{|}}{O}}{\underset{CF_2}{|}}}{C}FOCF_2CF_2SO_2F.$$

The most preferred sulfonyl fluoride containing comonomer is perfluoro(3,6-dioxa-4-methyl-7-octenesulfonyl fluoride), $$CF_2{=}CFOCF_2\underset{\underset{CF_3}{|}}{C}FOCF_2CF_2SO_2F.$$

The sulfonyl-containing monomers are disclosed in such references as U.S. Pat. Nos. 3,282,875; 3,041,317; 3,718,627; and 3,560,568.

A preferred class of such polymers is represented by polymers having the repeating units $$\left[CX_2-CX_2\right]_m\left[\begin{array}{c} CF-CF_2 \\ \big| \\ O \\ \big| \\ CF_2 \\ \big| \\ CF-Y \\ \big| \\ O \\ \big| \\ CF-R_f \\ \big| \\ CF_2 \\ \big| \\ SO_3M \end{array}\right]_{p\ n}$$

wherein m is 3 to 15, n is 1 to 10, p is 0, 1 or 2, the X's taken together are four fluorine or three fluorines and one chlorine, Y is F or $CF_3$, and $R_f$ is F, Cl or a $C_1$ to $C_{10}$ perfluoroalkyl radical.

The most preferred copolymer is a copolymer of tetrafluoroethylene and perfluoro(3,6-dioxa-4-methyl-7-octenesulfonyl fluoride) which comprises 20 to 65 percent, preferably, 25 to 50 percent by weight of the latter.

The melt-fabricable second polymer having carboxylic functional groups is typically a polymer having a fluorinated hydrocarbon backbone chain to which are attached the functional groups or pendant side chains which in turn carry the functional groups. The pendant side chains can contain, for example, $$-\left(\underset{\underset{Z}{|}}{CF}\right)_t-W$$

groups wherein Z is F or $CF_3$, t is 1 to 12, and W is —COOR or —CN, where R is lower alkyl. Ordinarily, the functional group in the side chains of the polymer will be present in terminal $$-O-\left(\underset{\underset{Z}{|}}{CF}\right)_t-W$$

groups. Examples of fluorinated polymers of this kind are disclosed in British Pat. No. 1,145,445 and U.S. Pat. No. 3,506,635. More specifically, the polymers can be prepared from monomers which are fluorinated or fluorine substituted vinyl compounds. The polymers are usually made from at least two monomers. At least one monomer is a fluorinated vinyl compound from the first group described hereinabove in reference to polymers containing $-SO_2F$ groups. Additionally, at least one monomer is a fluorinated monomer which contains a group which can be hydrolyzed to a carboxylic acid group, e.g., a carboalkoxyl or nitrile group, in a side chain as set forth above. Again in this case, as in the case of the polymers having $-SO_2F$ groups, the monomers, with the exception of the R group in the —COOR, will preferably not contain hydrogen, especially if the polymer blend will be used in the electrolysis of brine, and for greatest stability in harsh environments most preferably will be free of both hydrogen and chlorine, i.e., will be perfluorinated; the R group need not be fluorinated as it is lost during hydrolysis when the functional groups are converted to ion exchange groups.

One exemplary suitable type of carboxyl-containing monomer is represented by the formula $$CF_2{=}CF{-}(OCF_2\underset{\underset{Y}{|}}{C}F)_s{-}OCF_2{-}COOR$$

wherein

R is lower alkyl,

Y is F or $CF_3$, and s is 0, 1 or 2.

Those monomers wherein s is 1 are preferred because their preparation and isolation in good yield is more easily accomplished than when s is 0 or 2. The compound $$CF_2{=}CFOCF_2\underset{\underset{CF_3}{|}}{C}FOCF_2COOCH_3$$

is an especially useful monomer. Such monomers can be prepared, for example, from compounds having the formula $$CF_2{=}CF{-}(OCF_2\underset{\underset{Y}{|}}{C}F)_s{-}OCF_2CF_2SO_2F$$

wherein s and y are as defined above, by (1) saturating the terminal vinyl group with chlorine to protect it in subsequent steps by converting it to a $CF_2Cl$-$CFCl$-group; (2) oxidation with nitrogen dioxide to convert the $-OCF_2CF_2SO_2F$ group to an $-OCF_2COF$ group; (3) esterification with an alcohol such as methanol to form an $-OCF_2COOCH_3$ group; and (4) dechlorination with zinc dust to regenerate the terminal $CF_2{=}CF-$ group. It is also possible to replace steps (2) and (3) of this sequence by the steps (a) reduction of the $-OCF_2CF_2SO_2F$ group to a sulfinic acid, $-OCF_2CF_2SO_2H$, or alkali metal or alkaline earth metal salt thereof by treatment with a sulfite salt or hydrazine (b) oxidation of the sulfinic acid or salt thereof with oxygen or chromic acid, whereby $-OCF_2COOH$ groups or metal salts thereof are formed; and (c) esterification to $-OCF_2COOCH_3$ by known methods.

A preferred class of carboxyl-containing polymers is represented by polymers having the repeating units

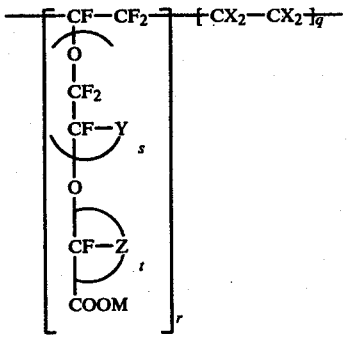

where q is 3 to 15, r is 1 to 10, s is 0, 1, or 2, t is 2, the X's taken together are four fluorines or three fluorines and one chlorine, Y is F or $CF_3$, Z is F or $CF_3$, and M is H or alkali metal.

The first and second polymers are blended by techniques familiar in the art. Powders, granules, or pellets of the individual polymers can first be mixed together. Such a mixture is then subjected to heat and pressure by various means, such as pressing, extruding in a screw extruded, or working on a roll mill or rubber mill. To assure formation of an intimate, uniform blend, the steps can be repeated two or more times. For example, pressed films can be flaked or cut into small pieces and repressed into film. Extruded polymer can be chopped into pellets as it is extruded, and then reextruded. Powders for blending can be made by grinding in a mill; cold grinding in a freezer mill is a useful technique.

Suitable polymer blends include those having at least 1 percent by weight, preferably 10 percent by weight, and most preferably 25 percent by weight of at least one first fluorinated polymer which contains sulfonyl groups, and complementally up to 99 percent by weight, preferably up to 90 percent by weight, and most preferably up to 75 percent by weight of at least one second fluorinated polymer which contains carboxylic functional groups. A blend of about 50 percent by weight of each component is highly useful.

The blends of the first and second polymers in melt-fabricable form are fabricated into film and membranes by techniques well known in the art, such as melt pressing and extrusion. Temperatures and pressures will vary depending on the polymer composition. Temperature and pressure must be high enough to provide a coalesced tough film free of holes, but not so high as to cause polymer decomposition. Fabrication temperatures of about 150° C. to 350° C. are generally required, and for many of the polymers 180° C. to 290° C. is preferred. Pressures can range from a few kilograms to many thousands of kilograms.

When the polymer is in the form of a film, desirable thicknesses of the order of 0.025 to 0.5 mm (0.001 to 0.02 inch) are ordinarily used. Excessive film thicknesses will aid in obtaining higher strength, but with the resulting deficiency of increased electrical resistance.

The term "membrane" refers to nonporous structures for separating compartments of an electrolysis cell and which may have layers of different materials, formed, for example, by surface modification of films or by lamination, and to structures having as one layer a support, such as a fabric imbedded therein.

The reinforcement fabric for encapsulation within the membrane can be either woven or unwoven, although a woven fabric is preferred. The individual fibers of the fabric should be able to withstand a temperature from about 240° C. to about 320° C., since these temperatures are employed in the laminating steps. With this proviso, the individual reinforcing fibers can be made from conventional materials, since their main purpose is to strengthen the membrane. Due to chemical inertness, reinforcement materials made from perfluorinated polymers have been found to be preferred. The polymers include those made from tetrafluoroethylene and copolymers of tetrafluoroethylene with hexafluoropropylene and perfluoro(alkyl vinyl ethers) with alkyl being 1 to 10 carbon atoms such as perfluoro(propyl vinyl ether). An example of a most preferred reinforcement material is polytetrafluoroethylene. Supporting fibers made from chlorotrifluoroethylene polymers are also useful. Other suitable reinforcing materials include quartz and glass. Such reinforcement fibers and their use to strengthen polymers in a membrane are well known in the prior art.

The cation exchange membranes, for example, in sheet form, are placed between each anode and cathode to form separate anode and cathode compartments. The membranes are held in place between adjacent anode and cathode frames using appropriate sealing means such as gaskets, etc. To reduce the cell voltage, during operation of the cell, for example, in the electrolysis of alkali metal chloride brines, the membrane is brought in direct contact with the one electrode surface and spaced apart from the electrode surface of opposite polarity. Any suitable means may be used to assure contact of the cation exchange membrane with the electrode surface including pressure means such as hydraulic pressure or gas pressure or mechanical means such as spacers and the like. In a preferred embodiment, the membrane is maintained in contact with the electrode surface by a hydraulic pressure differential obtained by maintaining the electrolyte in one electrode compartment at a higher level than that of the electrolyte in the electrode compartment of opposite polarity. For example, where the membrane is in contact with the anode surface, suitable differential pressures are defined such that the hydrostatic pressure of the catholyte plus the gas pressure over the catholyte minus the hydrostatic pressure of the anolyte minus the gas pressure over the anolyte is from about 0.01 to about 25 inches when the solution in the cathode chamber corresponds to a gas-free solution having specific gravities from about 1.05 to 1.55 and the solution in the anode chamber corresponds to a gas-free solution having specific gravities of 1.08 to 1.20. Preferred differential pressures are those from about 5 to about 25 and more preferred pressures are those from about 10 to about 25 inches.

In this embodiment, the space between the membrane and the cathode is maintained at from about 0.1 to about 15, and preferably from about 0.5 to about 6 millimeters.

In a preferred embodiment, the membrane is in direct contact with the anode surface and spaced apart from the cathode surface.

The novel monopolar membrane electrolytic cell of the present invention is suitably used in the electrolysis of aqueous solutions of alkali metal chlorides in the production of chlorine gas and alkali metal hydroxides. Preferred as alkali metal hydroxides are sodium chloride and potassium chloride, with sodium chloride being particularly preferred. Employing the novel monopolar membrane electrolytic cell, sodium chloride brines having a weight concentration of NaCl in the range of from about 100 to about 325 and preferably from about 200 to 305 grams per liter are fed to the anode. Water or an aqueous solution of sodium hydroxide is provided to the cathodes in amounts sufficient to apply the required differential pressure from the cathode compartment to the anode compartment to maintain contact between the membrane and the anode surface. During electrolysis, the catholyte and the anolyte are maintained at the desired levels to provide the pressure differential between the two compartments. The novel monopolar membrane electrolytic cell operates at surprisingly low cell voltages to produce, for example, chlorine and sodium hydroxide at high current efficiencies where the sodium hydroxide concentration is in the range of from about 300 to about 800, and preferably from about 400 to about 700 grams per liter.

To further illustrate the novel monopolar membrane electrolytic cell of the present invention, the following examples are presented without any intention of being limited thereby. All parts and percentages are by weight unless otherwise specified.

EXAMPLE 1

Sodium chloride brine (300 gpl) at a temperature of 60° C. and a pH of 10 was fed to the anode compartment of a monopolar membrane electrolytic cell having a cation exchange membrane separating the anode compartment from the adjacent cathode compartment. The membrane was comprised of a melt-fabricated structure containing two perfluorinated polyolefin films encapsulating a polytetrafluoroethylene fabric. One perfluorinated polyolefin film contained a preponderance of sulfonyl functional groups and faced the anode. The second perfluorinated polyolefin film contained a preponderance of carboxylic functional groups and faced the cathode. The anode was a titanium mesh structure coated with a non-stoichiometric metal platinate compound (Grelcon, Inc.). The cathode was comprised of a nickel mesh having a catalytic coating of a predominantly Beta phase Raney nickel-molybdenum alloy containing 15 percent by weight of Mo. An aqueous solution containing 32.79 percent by weight of NaOH was fed to the cathode compartment. The catholyte was maintained at a level above the level of the anolyte which provided a differential pressure of 24 inches which forced the membrane against the anode surface to substantially eliminate any membrane-anode gap. The cathode to membrane gap was about 1.6 millimeters. The cell was operated for a period of 132 days at a current density of 3.0 kiloamps per square meter while maintaining the cell temperature in the range of 85°–90° C. Caustic soda containing 31–33 percent by weight of NaOH was produced for a period of 118 days at cell voltages in the range of 3.15–3.24 volts and cathode current efficiencies in the range of 92.8–96.8 percent. The power consumption ranged from 2209 to 2380 kilowatt hours per metric ton of NaOH. Caustic soda containing 40–41 percent by weight of NaOH was produced for a period of 14 days at cell voltages of 3.35 to 3.43, current efficiencies of 89.5–90.75 percent, and a power consumption range of 2497–2549 kilowatt hours per metric ton of NaOH.

EXAMPLE 2

The monopolar membrane electrolytic cell used was identical to that of EXAMPLE 1 with the exception that the anode employed was a titanium mesh structure coated with a titanium oxide-ruthenium oxide mixed crystal (Diamond Shamrock). The cell was operated for a period of 98 days at a current density of 3.0 $KA/m^2$ and a cell temperature of 85°–89° C. The differential compartment which maintained the membrane against the anode surface was 24 inches. During the period of operation, the catholyte produced contained 31 to 33 percent by weight of NaOH at a cell voltage in the range of 3.17 to 3.24 volts and current efficiencies in the range of 91.3 to 96.8 percent. Power consumption was in the range of 2234 to 2365 KWH per metric ton of NaOH.

EXAMPLES 1 and 2 illustrate the operation of the novel cell of the present invention in which low cell voltages are combined with high current efficiencies. These are shown by the surprisingly low power consumption requirements to produce concentrated sodium hydroxide solutions of high purity.

Commercial diaphragm cells require about 2600 KWH to produce a metric ton of catholyte liquor containing only about 12 percent by weight of NaOH in comparison with the low energy requirements of less than 2400 KWH per metric ton of catholyte liquor containing 31–33 percent by weight of NaOH.

What is claimed is:

1. A monopolar membrane electrolytic cell which comprises:

(a) a plurality of anodes wherein each anode is comprised of a first foraminous surface and a second foraminous surface positioned in parallel and spaced apart, and a frame enclosing said first and said second foraminous surfaces, said frame having two side members, a top member, and a bottom member attached to said foraminous surfaces, a chamber formed between said foraminous surfaces and bounded by said frame, conductor rods passing through one of said side members of said frame into said chamber, said conductor rods being spaced apart from said foraminous surfaces, foraminous conductive connectors positioned in said chamber and attached to said conductor rods and to said foraminous surfaces;

(b) a plurality of cathodes wherein each said cathode is comprised of at least one foraminous surface having a catalytic coating of a Beta phase Raney nickel-molybdenum alloy, and a frame enclosing said foraminous surface, said cathodes being alternatingly interleaved with said anodes;

(c) a plurality of sheets of cation exchange membrane material, each of said sheets being pressed between each opposite pair of said anodes and said cathodes, said sheets being in direct contact with said anodes, said cation exchange membrane material being comprised of a blend of 10 to 90 percent by weight of a first fluorinated polymer which has repeating units

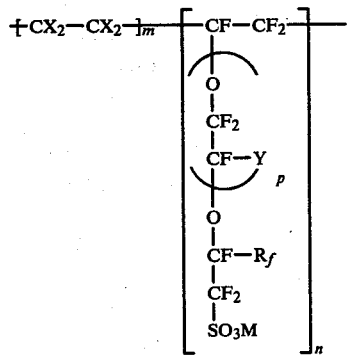

where m is 3 to 15,
n is 1 to 10,
p is 0, 1, or 2,
the X's taken together are four fluorines or three fluorines and one chlorine,
Y is F or $CF_3$,
$R_f$ is F, Cl, or a $C_1$ to $C_{10}$ perfluoroalkyl radical, and
M is H or alkali metal, and 90 to 10 percent by weight of a second fluorinated polymer which has repeating units

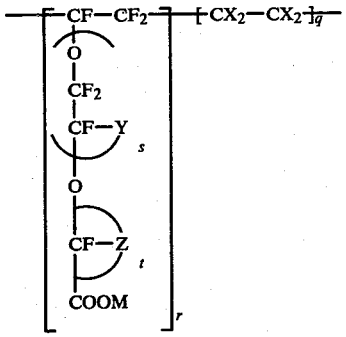

where q is 3 to 15,
r is 1 to 10,
s is 0, 1, or 2,
t is 2,
the X's taken together are four fluorines or three fluorines and one chlorine,
Y is F or $CF_3$,
Z is F or $CF_3$, and
M is H or alkali metal;

(d) raw material supply conduits and product withdrawal conduits communicating with the interior of each of said anodes and said cathodes;

(e) means for supplying electric current to said anodes and removing electric current from said cathodes; and (f) pressing means for pressing said anodes and said cathodes together to form a substantially fluid-tight cell.

2. The monopolar membrane electrolytic cell of claim 1 in which said conductor rods are substantially horizontal.

3. The monopolar membrane electrolytic cell of claim 2 in which said foraminous conductive connectors are comprised of a metal form selected from the group consisting of wire mesh, expanded metal mesh, perforated sheet, a slit sheet or louvered sheet.

4. The monopolar membrane electrolytic cell of claim 3 in which each polymer has an equivalent weight of no greater than 2,000.

5. The monopolar membrane electrolytic cell of claim 2 in which the configuration of said foraminous conductive connector is an inverted curve selected from the group consisting of "U", "V", semicircular, parabolic, semi-elliptical, semi-octagonal, or semi-rectangular.

6. The monopolar membrane electrolytic cell of claim 5 in which said foraminous conductive connectors are comprised of an expanded metal mesh.

7. The monopolar membrane electrolytic cell of claim 6 in which said foraminous conductive connectors have an open area which comprises from about 0.2 to about 2 times the interior horizontal cross sectional area of th electrode.

8. The monopolar membrane electrolytic cell of claim 7 in which said Raney nickel metal surface layer is predominantly derived from an adherent $Ni_xMo_{1-x}Al_3$ crystalline precursory surface layer structure in which x is from about 0.75 to about 0.99.

9. The monopolar membrane electrolytic cell of claim 8 in which said cathode is spaced apart from said membrane a distance of from about 0.1 to about 15 millimeters.

* * * * *

UNITED STATES PATENT AND TRADEMARK OFFICE

CERTIFICATE OF CORRECTION

PATENT NO. : 4,439,297

DATED : March 27, 1984

INVENTOR(S) : Morton S. Kircher, David D. Justice, Kenneth E. Woodard, Jr., and Charles H. Harrison It is certified that error appears in the above-identified patent and that said Letters Patent is hereby corrected as shown below:

Column 2, line 53, after "overvoltages." the word "These" should be the start of a new paragraph.

Column 12, lines 1-16, delete

" 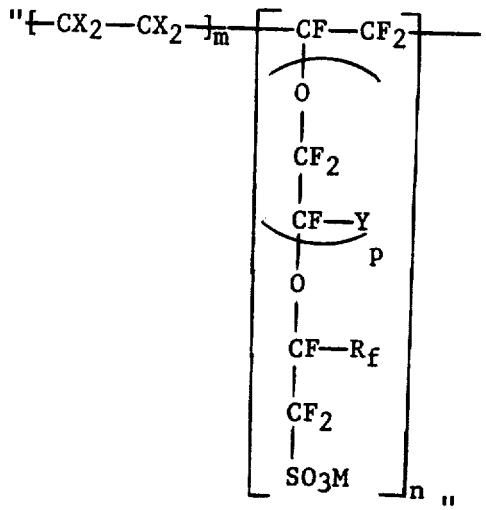

"

UNITED STATES PATENT AND TRADEMARK OFFICE

CERTIFICATE OF CORRECTION

PATENT NO. : 4,439,297

DATED : March 27, 1984

INVENTOR(S) : Morton S. Kircher, David D. Justice, Kenneth E. Woodard, Jr., and Charles H. Harrison It is certified that error appears in the above-identified patent and that said Letters Patent is hereby corrected as shown below:

Column 12, lines 1-16, insert

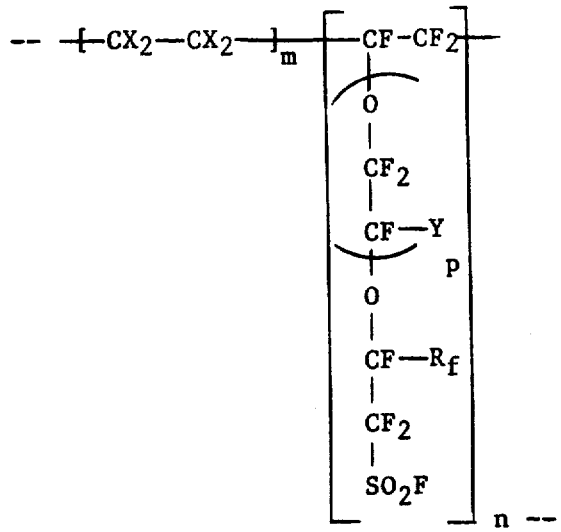

UNITED STATES PATENT AND TRADEMARK OFFICE

CERTIFICATE OF CORRECTION

PATENT NO. : 4,439,297

DATED : March 27, 1984

INVENTOR(S) : Morton S. Kircher, David D. Justice, Kenneth E. Woodard, Jr., and Charles H. Harrison It is certified that error appears in the above-identified patent and that said Letters Patent is hereby corrected as shown below:

Column 17, line 12, after "differential" insert --pressure between the cathode compartment and the anode--.

Column 20, Claim 7, line 5, after "of" delete "th" and insert --the--.

Signed and Sealed this

*Sixteenth* Day of *October 1984*

[SEAL]

*Attest:*

*Attesting Officer*

GERALD J. MOSSINGHOFF

*Commissioner of Patents and Trademarks*